US006810955B2

(12) United States Patent
Roth et al.

(10) Patent No.: US 6,810,955 B2
(45) Date of Patent: Nov. 2, 2004

(54) GAS LIFT MANDREL

(75) Inventors: Brian A. Roth, Houston, TX (US); Roger D. Hegdahl, Crosby, TX (US); James H. Kritzler, Pearland, TX (US)

(73) Assignee: Baker Hughes Incorporated, Houston, TX (US)

( * ) Notice: Subject to any disclaimer, the term of this patent is extended or adjusted under 35 U.S.C. 154(b) by 68 days.

(21) Appl. No.: 10/226,367

(22) Filed: Aug. 22, 2002

(65) Prior Publication Data

US 2004/0035575 A1 Feb. 26, 2004

(51) Int. Cl.[7] ..... E21B 34/06

(52) U.S. Cl. ..... 166/242.5; 166/316; 29/456; 137/155

(58) Field of Search ..... 166/242.5, 65.1, 166/316, 372, 117.5, 162; 29/456; 137/155

(56) References Cited

U.S. PATENT DOCUMENTS 2,845,940 A 8/1958 Garrett et al.
3,059,700 A 10/1962 Loy, III et al.
3,454,093 A 7/1969 Garrett
4,110,057 A * 8/1978 McMurry et al. ..... 417/109
4,416,330 A 11/1983 Merritt et al.
4,480,686 A * 11/1984 Coussan ..... 166/117.5
4,505,331 A 3/1985 Akkerman ..... 166/117.5
4,553,310 A 11/1985 Logan
5,782,261 A 7/1998 Becker et al.
5,785,124 A 7/1998 Hisaw et al.
5,797,453 A 8/1998 Hisaw
6,305,402 B2 10/2001 Pringle
6,422,312 B1 * 7/2002 Delatorre et al. ..... 166/250.15

* cited by examiner

*Primary Examiner*—Zakiya Walker
(74) *Attorney, Agent, or Firm*—Gerald W. Spinks

(57) ABSTRACT

A side-pocket gas lift mandrel having tapered end caps threaded onto the ends of the mandrel with metal-to-metal sealing threads. The thickness of each made up thread set is the same as the thickness of the small end of each end cap, resulting in a mandrel having the same outside diameter as if the end caps were welded on, without sacrificing any inside diameter in the small ends of the end caps, compared to a welded mandrel.

2 Claims, 1 Drawing Sheet

GAS LIFT MANDREL

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention is in the field of devices used in gas lift operations in oil wells.

2. Background Art

An oil well is drilled into a hydrocarbon bearing earth formation, where the well is typically "completed" to allow production of hydrocarbon material from the formation. Hydrocarbon production often begins with sufficient gas pressure in the formation to force the oil to the surface. As production from the well continues, the reservoir usually loses pressure until production of oil from the well is no longer provided by the formation gas. Sometimes, the formation pressure is insufficient to support production, even when the well is first completed.

In either case, it is common to modify a well to allow the injection of pressurized gas from the surface, to supplement the formation gas in lifting the well fluids to the surface. This is commonly called a "gas lift" operation. More specifically, high pressure gas from the surface may be applied to the annulus of the well surrounding the production tubing. This gas enters the production tubing from the annulus, through a gas lift valving mechanism which is commonly positioned in a side pocket or bore, commonly called a valve pocket, within a mandrel. Passages are commonly provided for the gas into the valve pocket, through the mandrel wall from the annulus. The valve in the valve pocket then controls the actual flow of gas according to its specific design. The mandrel body, sometimes called a "valve body", is also typically equipped with another passage, or through-bore, which goes straight through the valve body and on down the production tubing.

When the gas enters the production tubing via the mandrel, it can be used to create a venturi effect and draw well fluids into the production tubing. The gas can also entrain itself into the well fluids, thereby lowering the specific gravity of the fluid and assisting in removal of the fluid from the well. A similar mandrel can be used for water or chemical injection into the well, through the tubing, from the surface.

The valve which actually controls gas flow is typically lowered through the production tubing by wireline and guided into the valve pocket, such as with a tool commonly called a "kickover tool". This allows placement of the valve pocket to one side of the mandrel body, parallel to, but laterally offset from the through-bore, and entirely out of the through-bore. That is, the through-bore commonly runs straight from one production tubing connection, alongside the valve pocket, to a second production tubing connection. This parallel but offset arrangement is facilitated by the use of transitional end caps or "swages" on the ends of the mandrel body. The end caps are referred to as "transitional" pieces herein, because they transition in diameter from small to large, on the uphole end of the mandrel body, and from large back to small, on the downhole end of the mandrel body. Typically, that is, each end cap has a large end which matches the diameter of the valve body, and a small end which matches the diameter of the production tubing. The small end is offset completely against one side of the end cap, relative to the large end. In fact, the wall of the small end can align with the wall of the large end, and the two ends can have identical wall thicknesses. So, when installed, the large end aligns with the valve body, while the small end aligns with the through-bore in the valve body. This results in straight-through flow of production fluid, while generating minimal back pressure.

It is desirable to have a through-bore in the mandrel which has a "full bore" diameter, that is, where the inner diameter of the through-bore all the way through the mandrel body is at least as large as the inner diameter of the production tubing to which the small ends of the mandrel end caps are connected. One reason for this is that it is economically very important to maintain the inner diameter of the fluid production passage as large as possible, relative to the overall diameter of the mandrel. Another way to state this is that it is very important to minimize the overall diameter of the mandrel relative to the inner diameter of the through-bore. Put either way, the point is to be able to install as small a mandrel as possible, with a through-bore as large as possible, to maximize the rate of production of fluid from a given diameter of well casing.

Known gas lift mandrels have most often had the transitional end caps welded to the valve body, or they have been one-piece mandrels, cast or machined with integral end caps. Welded mandrels have high manufacturing costs, and they tend to be less uniform than desired, while one-piece mandrels have high tooling costs, and high capital equipment costs. In the past, attempts to thread the end caps onto the valve body have failed, because the thread designs utilized were thicker than the wall thickness of the components they joined, and because o-rings were required to achieve fluid tight seals. Bulky thread sets, with wall thickness thicker than the joined components, had the distinct disadvantage of increasing the overall diameter of the mandrel assembly, and decreasing the diameter of the through-bore flow path, at least where it passed through the thread sets. This resulted in the use of a smaller mandrel body, and a smaller through-bore diameter, in a given size of casing. Mandrels and other tubular components sealed with o-rings have not been favored, because of the tendency to lose the seal under harsh downhole conditions.

Therefore, it would be desirable to have a gas lift mandrel which operates exactly the same as mandrels with which operators are familiar, but which have separate end caps joined to the mandrel body by some process other than welding, where the resulting mandrel assembly has as large a through-bore diameter as possible, and as small an overall diameter as possible, and where the end caps reliably maintain their seals for the life of the mandrel.

BRIEF SUMMARY OF THE INVENTION

The present invention provides a side-pocket type gas lift mandrel in which the transitional end caps are threaded to the mandrel body. The threads used on each component have a thickness no greater than the wall thickness of the component itself. Further, when male and female threads are threaded together, they create a thread set which has a thickness no greater than the wall thickness of either of the two components joined thereby. When the end caps are threaded to the mandrel body with these threads, the overall diameter of the assembly, at the locations of the thread sets, is no greater than the overall diameter of the mandrel body itself. Also, since the thickness of the assembled thread set is no greater than the wall thickness of the end cap, there is no reduction in the inside diameter of the through-bore as it passes through the thread set.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
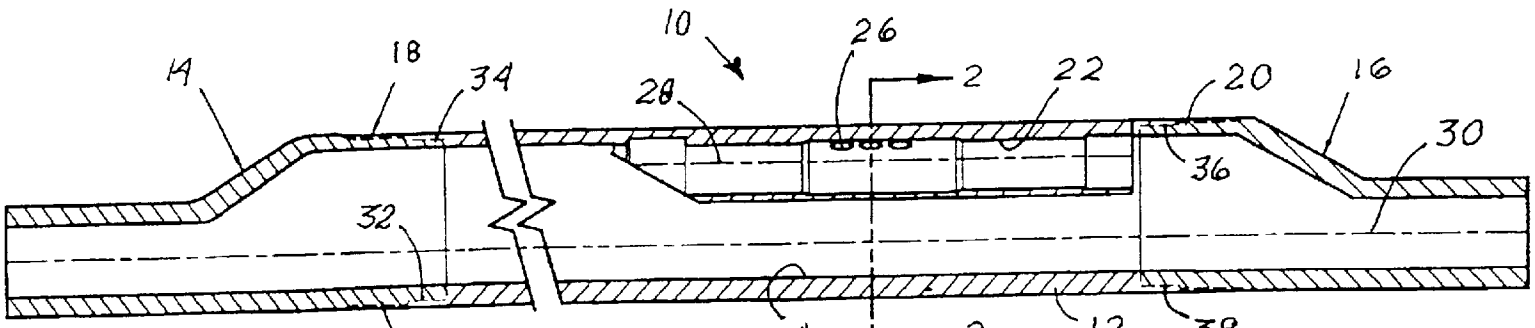
FIG. 1 is a longitudinal section view of a gas lift mandrel according to the present invention.

As shown in FIG. 1, one embodiment of a gas lift mandrel assembly 10 according to the present invention includes a mandrel body or valve body 12, and upper and lower transitional end pieces or end caps 14,16. Each end cap 14,16 has a smaller end with an axis offset from the axis of a larger end. An upper thread set 18 joins the lower, larger end of the upper transitional piece 14 to the upper end of the valve body 12. Similarly, a lower thread set 20 joins the upper, larger end of the lower transitional piece 16 to the lower end of the valve body 12.

A longitudinally oriented valve pocket or valve bore 22 is welded, machined, or otherwise formed, within the valve body 12. The valve bore 22 is positioned next to one side of the valve body 12. A full bore, or full diameter, through-bore 24 is formed longitudinally through the valve body 12, next to the opposite side of the valve body 12. The valve pocket axis 28 is parallel to, but laterally offset from, the through-bore axis 30, both of which are parallel to, but laterally offset from, the axis of the valve body 12.

Figure 2:
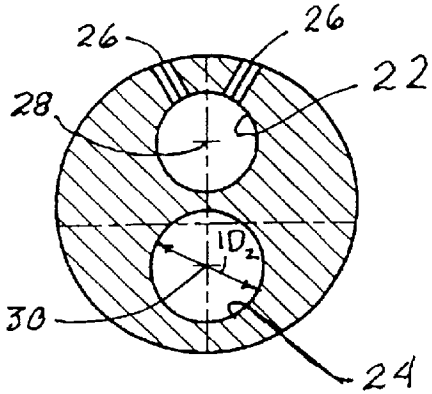
FIG. 2 is a transverse section view of the gas lift mandrel of FIG. 1, taken at the line 2—2.

Further, as can also be seen in FIG. 2, the valve pocket bore 22 itself is entirely laterally offset from the through-bore 24. A plurality of ports 26 communicate gas flow between the valve pocket bore 22 and the annulus surrounding the valve body 12. A valve (not shown) which can be positioned in the valve bore 22 would be used to control flow through these ports 26. The valve body 12 is shown in FIG. 2 as a solid cylinder with longitudinal bores 22,24 and transverse bores 26 therethrough, but other forms of construction could also be used without departing from the present invention.

Referring again to FIG. 1, low profile female threads 32,36 are formed at the 10 upper and lower ends of the valve body 12. Low profile male threads 34 are formed at the lower, larger, end of the upper transition piece or end cap 14. Similarly, low profile male threads 38 are formed at the upper, larger, end of the lower transition piece or end cap 16. Alternatively, female threads could be formed on the end caps 14,16, and male threads could be formed on the valve body 12, without departing from the present invention. These low profile threads are capable of achieving a liquid tight seal with metal-to-metal contact, as is known in commonly available "premium threads" in the prior art. This eliminates any need for an o-ring in the fitting. Further, these low profile threads mate together to result in a thread set which has a thickness no greater than the wall thickness of each of the components joined thereby.

Figure 3:
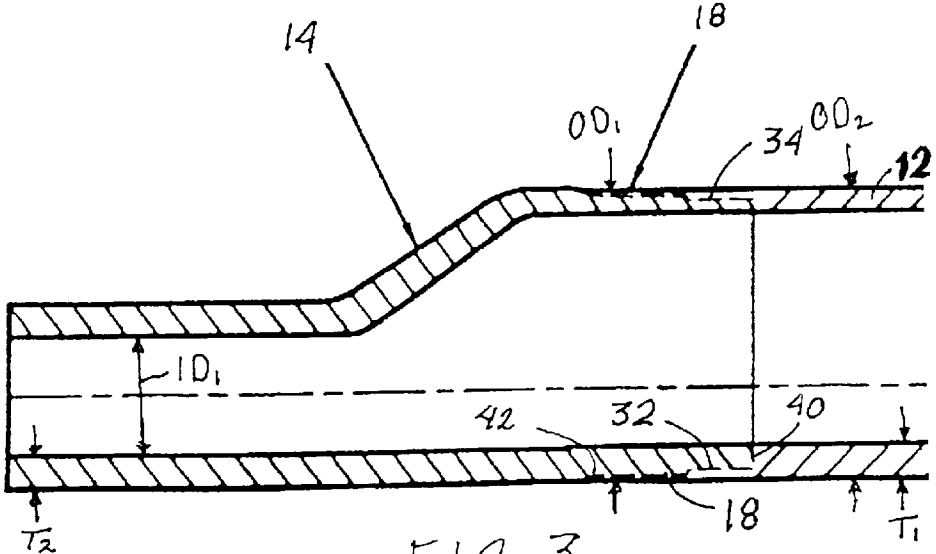
FIG. 3 is an enlarged section view of one end of the gas lift mandrel of FIG. 1.

As can best be seen in FIG. 3, provision of a low profile male thread 34 adjacent to the lower end 40 of the upper end cap 14, and provision of a low profile female thread 32 adjacent to the upper end 42 of the valve body 12, results in a low profile thread set 18 at this location. The outside diameter $OD_1$ of the thread set 18 is no greater than the outside diameter $OD_2$ of the valve body 12 itself. Therefore, use of the low profile thread set 18 avoids any increase in the overall outside diameter of the mandrel assembly 10, allowing the use of a valve body 12 as large as possible in a given size casing. As can best be seen in FIGS. 2 and 3, the low profile thread set 18 has a thickness no greater than the wall thickness $T_1$ of the upper end of the valve body 12, and no greater than the wall thickness $T_2$ of the upper end of the upper end cap 14. Therefore, use of the low profile thread set 18 avoids any decrease in the inside diameter $ID_2$ of the through-bore 24, relative to the inside diameter $ID_1$ of the upper end of the upper end cap 14. This provides a through-bore 24 as large as possible, for a given valve body 12. Identical results are achieved at the joint between the lower end cap 16 and the lower end of the valve body 12.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

We claim:

1. A gas lift mandrel, comprising:

a valve body having first and second ends;

a valve bore formed within said valve body;

a longitudinal through-bore formed within said valve body, said through-bore being laterally offset from said valve bore;

first and second hollow transition pieces;

a first end on each said transition piece coaxial with said through-bore in said valve body;

a second end on said first transition piece threaded to said first end of said valve body;

a second end on said second transition piece threaded to said second end of said valve body;

a first female thread on one of said first valve body end and said second end of said first transition piece;

a first male thread on the other of said first valve body end and said second end of said first transition piece, said first male thread mating with said first female thread to form a first thread set;

a second female thread on one of said second valve body end and said second end of said second transition piece; and a second male thread on the other of said second valve body end and said second end of said second transition piece, said second male thread mating with said second female thread to form a second thread set;

wherein said first thread set has a combined wall thickness the same as the wall thickness of said first end of said first transition piece; and wherein said second thread set has a combined wall thickness the same as the wall thickness of said first end of said second transition piece.

2. A method of manufacturing a gas lift mandrel, comprising:

forming a valve body with first and second threaded ends;

providing a valve bore within said valve body;

providing a longitudinal through-bore within said valve body, said through-bore being laterally offset from said valve bore;

forming first and second hollow transition pieces;

forming a first end on each said transition piece;

forming a threaded second end on each said transition piece;

threading said second end of said first transition piece to said first end of said valve body;

threading said second end of said second transition piece to said second end of said valve body; and aligning said first end of each said transition piece coaxially with said through-bore in said valve body;

forming a first female thread on one of said first valve body end and said second end of said first transition piece;

forming a first male thread on the other of said first valve body end and said second end of said first transition piece, said first male thread mating with said first female thread to form a first thread set;

forming a second female thread on one of said second valve body end and said second end of said second transition piece;

forming a second male thread on the other of said second valve body end and said second end of said second transition piece, said second male thread mating with said second female thread to form a second thread set;

dimensioning the thickness of said first male thread and the thickness of said first female thread to form said first thread set with a combined wall thickness the same as the wall thickness of said first end of said first transition piece; and dimensioning the thickness of said second male thread and the thickness of said second female thread to form said second thread set with a combined wall thickness the same as the wall thickness of said first end of said second transition piece.

* * * * *